US011191378B2

(12) United States Patent
Spence

(10) Patent No.: US 11,191,378 B2
(45) Date of Patent: Dec. 7, 2021

(54) LOCKABLE KNIFE BLOCK

(71) Applicant: Jerry Spence, Rock Hill, SC (US)

(72) Inventor: Jerry Spence, Rock Hill, SC (US)

( * ) Notice: Subject to any disclaimer, the term of this patent is extended or adjusted under 35 U.S.C. 154(b) by 93 days.

(21) Appl. No.: 16/747,616

(22) Filed: Jan. 21, 2020

(65) Prior Publication Data

US 2021/0219758 A1 Jul. 22, 2021

(51) Int. Cl.
*A47G 21/14* (2006.01)
*E05B 73/00* (2006.01)

(52) U.S. Cl.
CPC ..... *A47G 21/14* (2013.01); *E05B 73/00* (2013.01)

(58) Field of Classification Search
CPC ..... A47G 21/14; A47J 47/16; E05B 73/00
USPC ..... 211/70.7; 206/349
See application file for complete search history.

(56) References Cited

U.S. PATENT DOCUMENTS

D309,407 S 7/1990 May
5,245,756 A 9/1993 Howell
6,375,016 B1 4/2002 Stuchlik, III
D488,677 S 4/2004 Reichenbach
6,854,186 B2 2/2005 Basden
6,920,987 B2 7/2005 Siegel
7,631,772 B2 12/2009 Lafleur
8,590,427 B2 * 11/2013 Murphy ..... B24D 15/084 76/82
10,004,350 B1 * 6/2018 Liu ..... A47J 47/16
2004/0211737 A1 * 10/2004 Siegel ..... A47G 21/14 211/70.7
2012/0266468 A1 * 10/2012 Murphy ..... B24D 15/084 30/298.4
2017/0023302 A1 * 1/2017 Quinn ..... A47L 19/04
2018/0035833 A1 * 2/2018 Viskup ..... A47G 21/14
2019/0136577 A1 * 5/2019 Bullwinkel ..... E05B 65/06

FOREIGN PATENT DOCUMENTS

GB 2466253 4/2004

* cited by examiner

*Primary Examiner* — Patrick D Hawn
(74) *Attorney, Agent, or Firm* — Kyle A. Fletcher, Esq.

(57) ABSTRACT

The lockable knife block comprises a knife block and one or more knives. The knife block is a mechanical structure that stores one or more knives. The lockable knife block is a locking structure. The locking knife block comprises an interlock mechanism that inhibits an individual from removing an individual knife selected from the one or more knives from the knife block without releasing the interlock mechanism. The interlock mechanism is a lockable structure.

18 Claims, 7 Drawing Sheets

LOCKABLE KNIFE BLOCK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including tableware, more specifically, a knife rack. (A47G21/14)

SUMMARY OF INVENTION

The lockable knife block comprises a knife block and one or more knives. The knife block is a mechanical structure that stores one or more knives. The lockable knife block is a locking structure. The locking knife block comprises an interlock mechanism that inhibits an individual from removing an individual knife selected from the one or more knives from the knife block without releasing the interlock mechanism. The interlock mechanism is a lockable structure.

These together with additional objects, features and advantages of the lockable knife block will be readily apparent to those of ordinary skill in the art upon reading the following detailed description of the presently preferred, but nonetheless illustrative, embodiments when taken in conjunction with the accompanying drawings.

In this respect, before explaining the current embodiments of the lockable knife block in detail, it is to be understood that the lockable knife block is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the lockable knife block.

It is therefore important that the claims be regarded as including such equivalent construction insofar as they do not depart from the spirit and scope of the lockable knife block. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
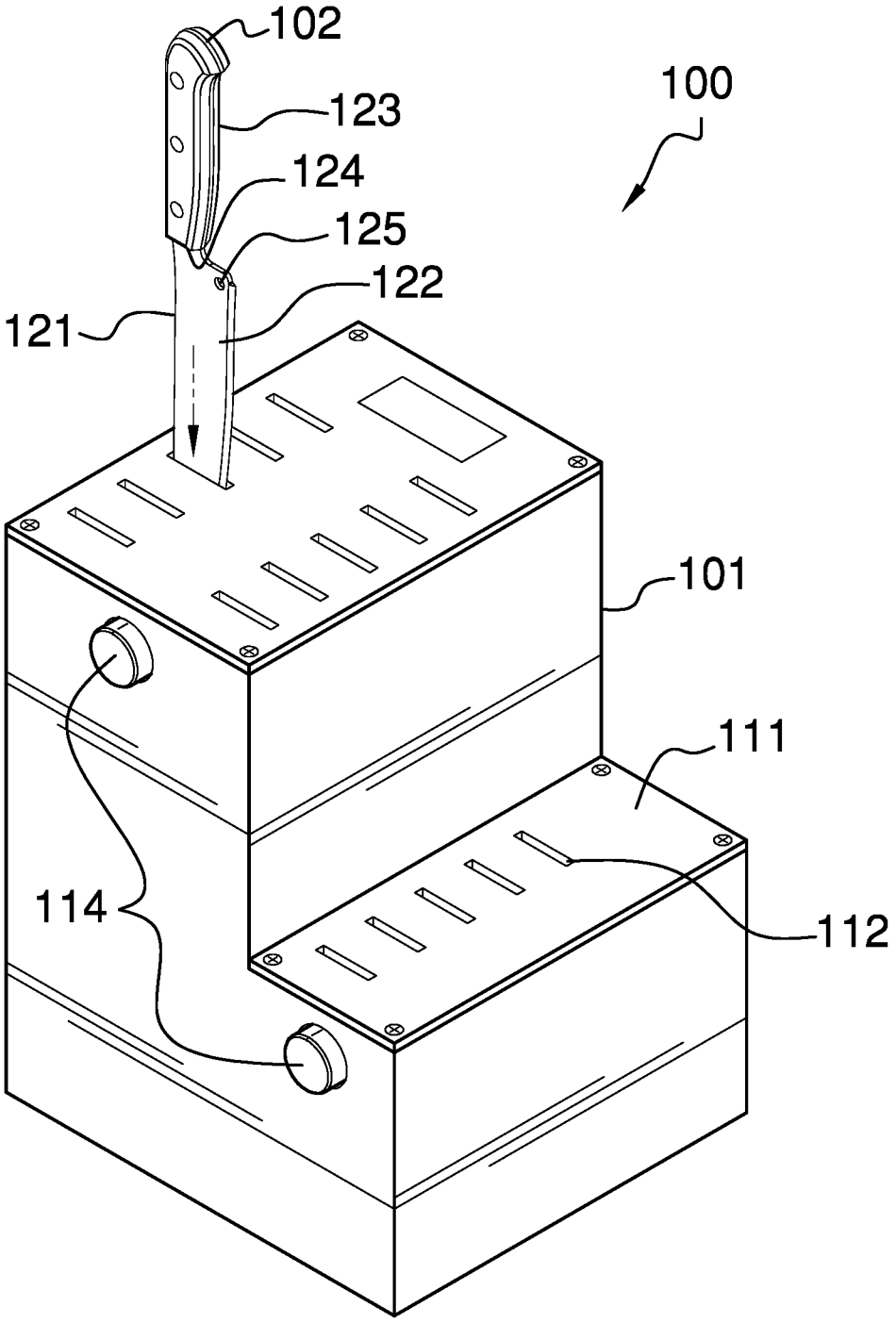
FIG. 1 is a perspective view of an embodiment of the disclosure.
Figure 2:
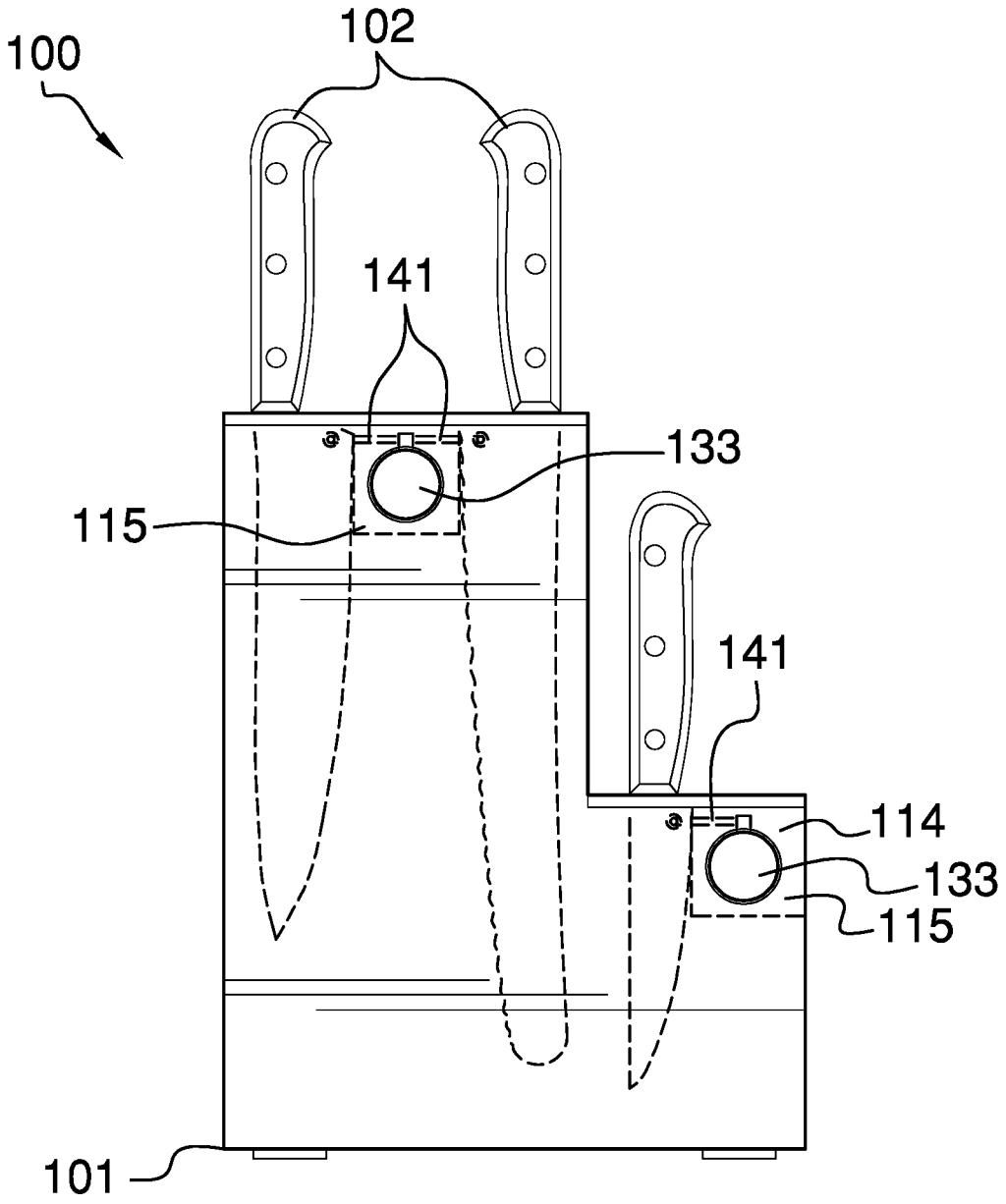
FIG. 2 is a side view of an embodiment of the disclosure.
Figure 3:
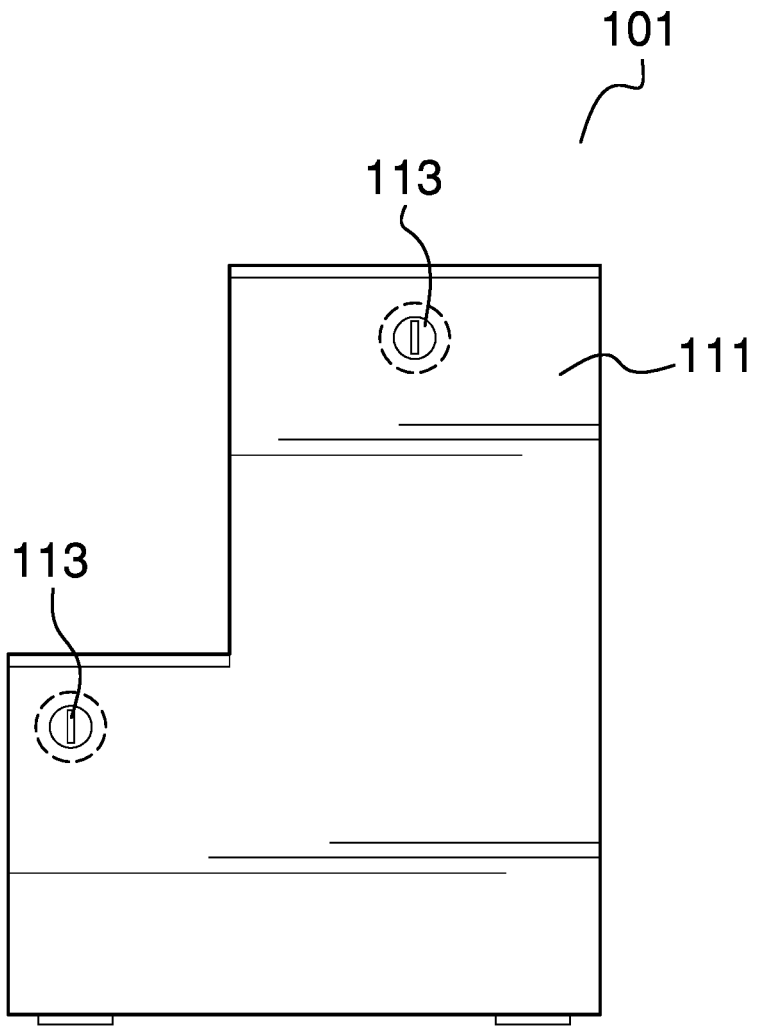
FIG. 3 is a reverse side view of an embodiment of the disclosure.
Figure 4:
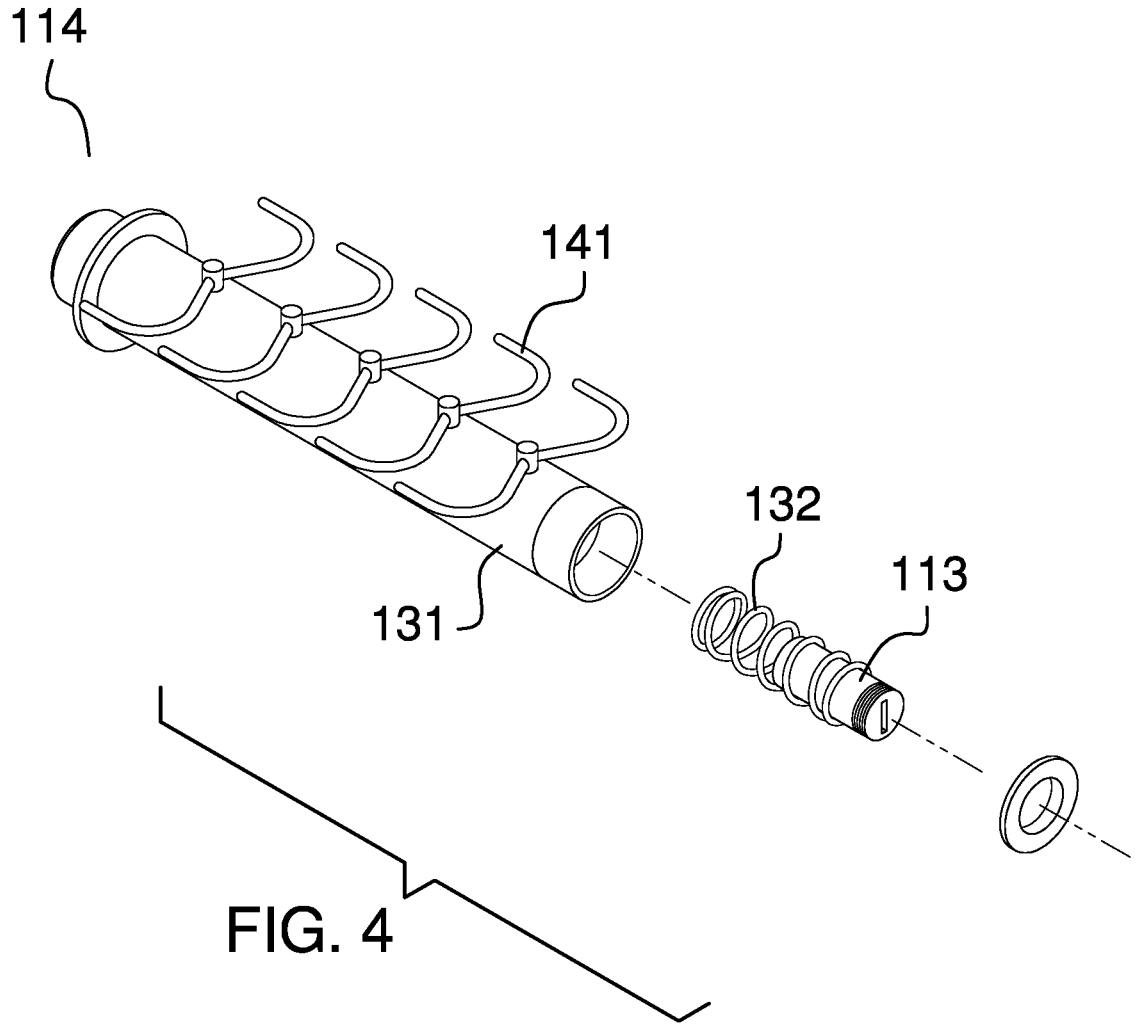
FIG. 4 is an exploded view of an embodiment of the disclosure.
Figure 5:
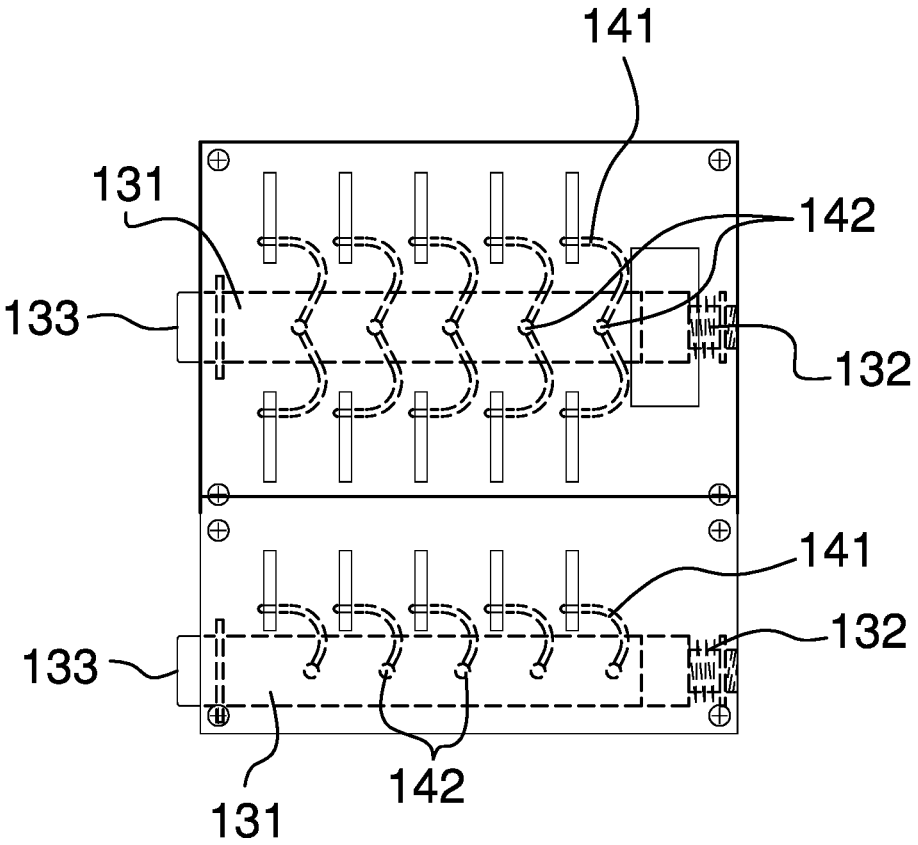
FIG. 5 is a top view of an embodiment of the disclosure.
Figure 6:
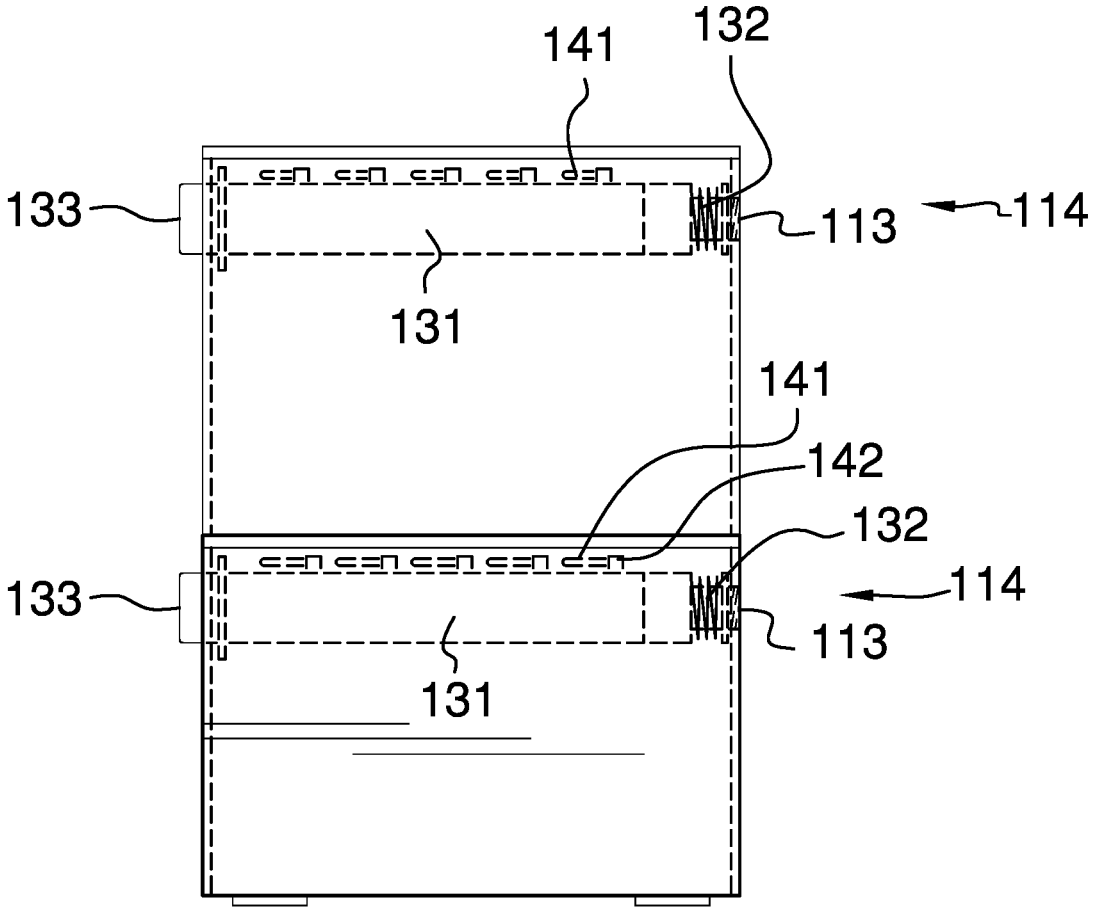
FIG. 6 is a front view of an embodiment of the disclosure.
Figure 7:
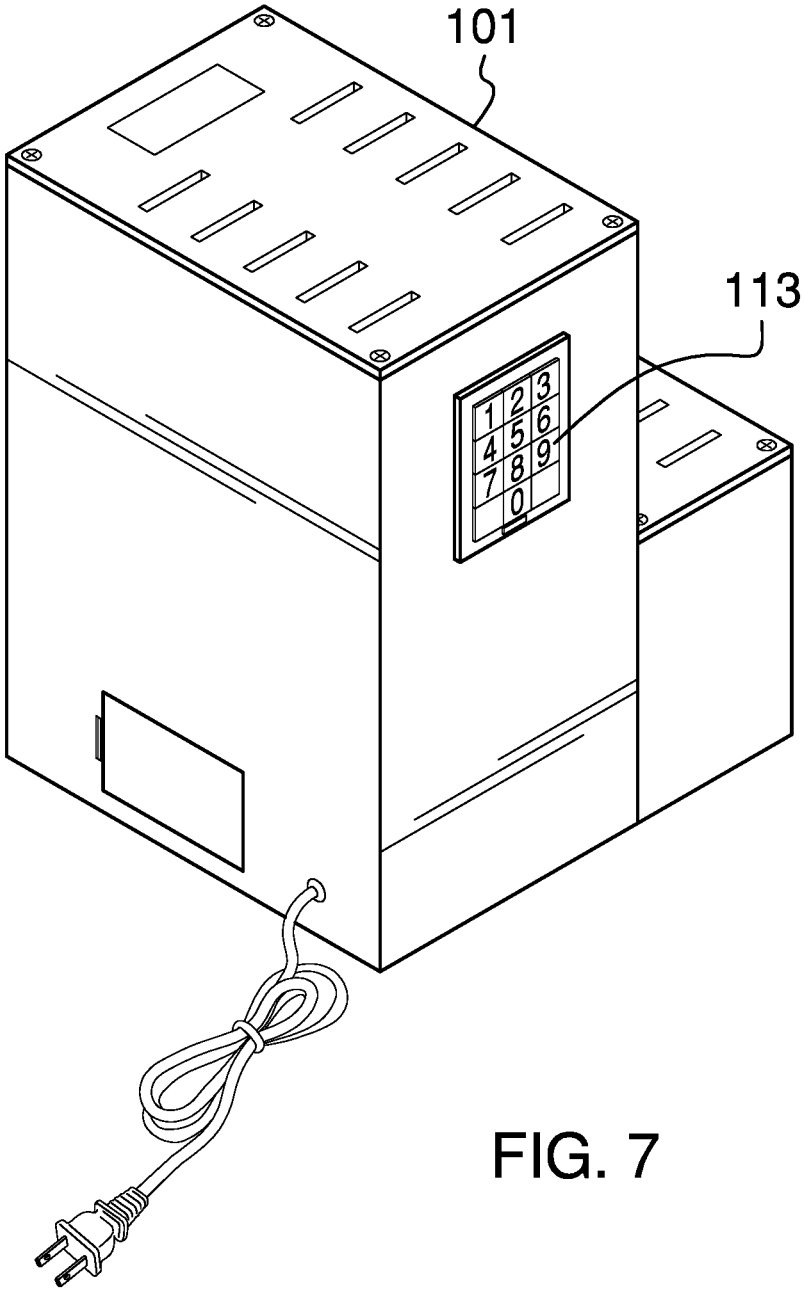
FIG. 7 is a perspective view of an alternate embodiment of the disclosure.

Detailed reference will now be made to one or more potential embodiments of the disclosure, which are illustrated in FIGS. 1 through 7.

The lockable knife block 100 (hereinafter invention) comprises a knife block 101 and one or more knives 102. The knife block 101 is a mechanical structure that stores the one or more knives 102. The knife block 101 is a locking structure. The knife block 101 comprises an interlock mechanism 114 that inhibits an individual from removing an individual knife 121 selected from the one or more knives 102 from the knife block 101 without releasing the interlock mechanism 114. The interlock mechanism 114 is a lockable structure.

The knife block 101 is a mechanical structure. The knife block 101 stores the one or more knives 102. The knife block 101 contains one or more knives 102 such that the removal of any individual knife 121 selected from the one or more knives 102 is inhibited. The knife block 101 contains the one or more knives 102 such that each individual knife 121 selected from the one or more knives 102 can be locked within the knife block 101. By inhibited is meant that the successful removal of any individual knife 121 selected from the one or more knives 102 requires the simultaneous release of an interlock mechanism 114 during the removal of the selected individual knife 121. By locked is meant that the interlock mechanism 114 is disabled such that the position of each of the one or more knives 102 remains fixed within the knife block 101.

The knife block 101 comprises a storage structure 111, one or more locking sleeves 112, a knife lock 113, and the interlock mechanism 114. The knife lock 113 and the interlock mechanism 114 are contained in an interlock cavity 115 formed in the storage structure 111. The one or more locking sleeves 112 are formed in the storage structure 111.

The one or more knives 102 comprises a collection of individual knifes 121 selected from the one or more knives 102.

The storage structure 111 is a mechanical structure. The storage structure 111 forms the primary shape of the knife block 101. In the first potential embodiment of the disclosure, the storage structure 111 has a rectangular block shape. Those skilled in the mechanical arts will recognize the knife lock 113 and the interlock mechanism 114 can be modified to accommodate other shapes of the storage structure 111. Each of the one or more locking sleeves 112 is a negative space. Each of the one or more locking sleeves 112 is a slot.

Each of the one or more locking sleeves 112 is sized to receive an individual knife 121 selected from the one or more knives 102. Each of the one or more locking sleeves 112 is configured to receive a specifically selected individual knife 121 such that the there is a one to one correspondence between the one or more locking sleeves 112 and the one or more knives 102. Each locking sleeve selected from the one or more locking sleeves 112 interacts with the interlock mechanism 114 such that the interlock mechanism 114 will fix the position of the selected individual knife 121 within the selected locking sleeve when the proper individual knife 121 selected from the one or more knives 102 inserts into the selected locking sleeve.

Each locking sleeve selected from the one or more locking sleeves 112 is formed with the form factors required to receive its associated individual knife 121 selected from the one or more knives 102. Each locking sleeve selected from the one or more locking sleeves 112 is formed with the apertures required to allow the interlock mechanism 114 to interact with the selected individual knife 121 associated with the selected locking sleeve.

The knife lock 113 is a lock. The lock is defined elsewhere in this disclosure. The knife lock 113 attaches to the interlock mechanism 114. The knife lock 113 moves between a second locked position and a second unlocked position. In the second locked position, the knife lock 113 prevents the rotation of the interlock mechanism 114 thereby preventing the removal of any individual knife 121 selected from the one or more knives 102 that is stored in the knife block 101. In the second unlocked position, the knife lock 113 enables the rotation of the interlock mechanism 114 thereby allowing the removal of any individual knife 121 selected from the one or more knives 102 when the interlock mechanism 114 is properly released.

The interlock mechanism 114 is a mechanical structure. The interlock mechanism 114 is a rotating structure. The interlock mechanism 114 rotates between a first locked position and a first unlocked position. In the first locked position, the interlock mechanism 114 prevents the removal of any individual knife 121 selected from the one or more knives 102 that is stored in the knife block 101. In the first unlocked position, the interlock mechanism 114 enables the removal of any individual knife 121 selected from the one or more knives 102 when the interlock mechanism 114 is properly released. The interlock mechanism 114 operates a latching mechanism that interacts with each of the one or more locking sleeves 112. The latching mechanism of the interlock mechanism 114 further interacts with each of the one or more knives 102.

The interlock mechanism 114 further comprises a primary lock prism 131, a spring mechanism 132, a spring piston 133, a plurality of rotating latches 141, and an interlock transmission 142. The spring mechanism 132, the spring piston 133, the plurality of rotating latches 141, and the interlock transmission 142 mount on the primary lock prism 131. The spring mechanism 132, the spring piston 133, the plurality of rotating latches 141, and the interlock transmission 142 are mechanically interconnected.

The primary lock prism 131 is a hollow prism structure. The primary lock prism 131 has a tube shape. The hollow interior space of the primary lock prism 131 contains the spring mechanism 132, the spring piston 133, and the interlock transmission 142. The plurality of rotating latches 141 mounts on the exterior surface of the lateral face of the primary lock prism 131.

The spring mechanism 132 is a spring based structure. The spring mechanism 132 is a prism-shaped structure. The spring mechanism 132 mechanically attaches to the spring piston 133 and the interlock transmission 142.

The spring piston 133 attaches to the spring mechanism 132 such that the application of a force to the spring piston 133 changes the span of the length of the spring mechanism 132. The spring piston 133 mounts within the spring mechanism 132 and the interlock cavity 115 of the knife block 101 such that the spring piston 133 is accessible from the exterior of the knife block 101. An externally provisioned force is applied to the spring piston 133 in order to release the interlock mechanism 114 such that an individual knife 121 can be removed from its associated locking sleeve.

The plurality of rotating latches 141 forms a rotating structure. The plurality of rotating latches 141 attach to the interlock transmission 142 such that the interlock transmission controls the rotation of the plurality of rotating latches 141. Each of the plurality of rotating latches 141 rotates between the first locked position and the first unlocked position in unison. There is a one to one correspondence between the plurality of rotating latches 141 and the one or more locking sleeves 112. Each rotating latch selected from the plurality of rotating latches 141 is positioned such that the selected rotating latch rotates into and rotates out its associated selected locking sleeve. Each rotating latch selected from the plurality of rotating latches 141 is positioned such that the selected rotating latch rotates into and rotates out the latch strike 125 of the individual knife 121 associated with the selected locking sleeve associated with the selected rotating latch.

The interlock transmission 142 is a mechanical structure. The interlock transmission 142 interacts with the spring mechanism 132 such that the interlock transmission 142 will rotate the plurality of rotating latches 141 in response to the deformation of the spring mechanism 132 by an external force. The interlock transmission 142 positions each of the plurality of rotating latches 141 in the first locked position when the spring mechanism 132 is in its relaxed shape. The interlock transmission 142 rotates each of the plurality of rotating latches 141 towards the first unlocked position as the spring mechanism 132 is deformed by and externally provisioned force transferred to the spring mechanism 132 through the primary lock prism 131. The interlock transmission 142 returns the plurality of rotating latches 141 back to the first locked position as the spring mechanism 132 returns to its relaxed shape.

The interlock transmission 142 further interconnects with the knife lock 113. Specifically, the knife lock 113 moves and fixes the interlock transmission 142 into the first locked position when the knife lock 113 is in the second locked position. The knife lock 113 allows the interlock transmission 142 to operate freely when the knife lock 113 is in the second unlocked position. The knife lock 113 installs within the interlock cavity 115 such that the knife lock 113 is accessible from the exterior of the primary lock prism 131. In the first potential embodiment of the disclosure, the knife lock 113 is a key operated structure. In the second potential embodiment of the disclosure, the knife lock 113 is an electronic lock. The lock and the electronic lock are defined elsewhere in this disclosure.

The interlock cavity 115 is a negative space formed within the knife block 101. The interlock cavity 115 contains the interlock mechanism 114. The storage structure 111 is formed with all the apertures and form factors required to allow the mounting and the operation of the interlock mechanism 114 within the storage structure 111. The interlock cavity 115 forms passages within the storage structure 111 that allow physical access into each of the one or more locking sleeves 112 for the interlock mechanism 114 from the interlock cavity 115.

The individual knife 121 is a tool configured for use in bifurcating an object. The individual knife 121 is a cutting tool. The individual knife 121 is sized to insert into a locking sleeve selected from the one or more locking sleeves 112. The selected locking sleeve is customized to receive the individual knife 121 such that the individual knife 121 is properly positioned within the selected locking sleeve to receive a rotating latch selected from the plurality of rotating latches 141 that is associated for use with the selected locking sleeve. Each of the one or more knives 102 is a cutting tool. Each of the one or more knives 102 is stored in the knife block 101. The knife block 101 fastens the one or more knives 102 within the knife block 101 until an individual knife 121 selected from the one or more knives 102 is released from the knife block 101. Each individual knife 121 selected from the one or more knives 102 comprises a blade 122, a handle 123, a bolster 124, and a latch strike 125.

The blade 122 forms the working element of the individual knife 121. The blade 122 forms a cutting edge used to bifurcate an object. The blade 122 is a wedge shaped object. The handle 123 is a grip used to safely manipulate the individual knife 121. The bolster 124 is a mechanical structure. The bolster 124 attaches the handle 123 to the blade 122.

The latch strike 125 is an aperture that is formed through the faces of the blade 122 with the two greatest surface areas. The latch strike 125 is sized to receive a rotating latch selected from the plurality of rotating latches 141. The selected rotating latch inserts through the latch strike 125 when the spring mechanism 132 is in its relaxed shape. The selected rotating latch withdraws from the latch strike 125 when the spring mechanism 132 is deformed by the spring piston 133. When the selected rotating latch is withdrawn from the latch strike 125, the removal of the individual knife 121 from the associated locking sleeve is enabled.

The following definitions were used in this disclosure:

Aperture: As used in this disclosure, an aperture is a prism-shaped negative space that is formed completely through a structure or the surface of a structure.

Bifurcate: As used in this disclosure, to bifurcate means to divide an object or space into two pieces or segments.

Blade: As used in this disclosure, a blade is a term that is used to describe: 1) a wide and flat portion of a structure; or, 2) the cutting edge of a tool.

Bolster: As used in this disclosure, a bolster is the location of a knife where the blade joins the handle.

Cavity: As used in this disclosure, a cavity is an empty space or negative space that is formed within an object. See Saucer Electronic Lock: As used in this disclosure, an electronic lock is an electromechanically operated lock that: 1) mechanically locks an object; and, 2) is secured and released using an electrical or electronically driven mechanism.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Interlock: As used in this disclosure, an interlock is a device that disables the operation of a first mechanism without the release of a second mechanism. Generally, an interlock is used as a safety device.

Knife: As used in this disclosure, a knife is a bladed tool used to cut objects.

Latch: As used in this disclosure, a latch is a fastening or locking mechanism. The use of the term latch does not necessarily but often implies the insertion of an object into a notch or cavity.

Lock: As used in this disclosure, a lock is a fastening device that fixes the position of a first object relative to a second object such that the first object and the second object are subsequently releasable.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Piston: As used in this disclosure, a piston is a prism, disk, or shaft that fits closely in a housing and that moves along its center axis Primary Shape: As used in this disclosure, the primary shape refers to a description of the overall geometric shape of an object that is assembled from multiple components.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rectilinear Block: As used in this disclosure, a rectilinear block refers to a three-dimensional structure comprising a plurality of rectangular surfaces. Rectilinear blocks are similar to rectangular blocks and are often used to create a structure with a reduced interior volume relative to a rectangular block. Within this disclosure, a rectilinear block may further comprise rounded edges and corners.

Rotation: As used in this disclosure, rotation refers to the cyclic movement of an object around a fixed point or fixed axis. The verb of rotation is to rotate.

Sleeve: As used in this disclosure, a sleeve is a tube like covering that is placed over a rod, shaft or other cylindrical object.

Slot: As used in this disclosure, a slot is a long narrow cavity or aperture that is formed in or through an object.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Tool: As used in this disclosure, a tool is a device, an apparatus, or an instrument that is used to carry out an activity, operation, or procedure.

Transmission: As used in this disclosure, a transmission is a device that transmits the energy of motion from a first location to a second location.

Wedge: As used in this disclosure, a wedge is a modification to a prism-shaped structure wherein: a) the span of the distance of the diameter varies continuously as a function of the position of the center axis of the prism; and, b) the two congruent ends of the prism structure remain geometrically similar. A blade is a wedge-like structure that ultimately forms a cutting edge.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A knife storage device comprising a knife block and one or more knives;

wherein the knife block is a mechanical structure that stores the one or more knives;

wherein the knife block contains one or more knives such that the removal of any individual knife selected from the one or more knives is inhibited;

wherein the knife block contains the one or more knives such that each individual knife selected from the one or more knives can be locked within the knife block;

wherein by inhibited is meant that the successful removal of any individual knife selected from the one or more knives requires the simultaneous release of an interlock mechanism during the removal of the selected individual knife;

wherein by locked is meant that the interlock mechanism is disabled such that the position of each of the one or more knives remains fixed within the knife block;

wherein the interlock mechanism further comprises a primary lock prism, a spring mechanism, a spring piston, a plurality of rotating latches, and an interlock transmission;

wherein the spring mechanism, the spring piston, the plurality of rotating latches, and the interlock transmission mount on the primary lock prism;

wherein the spring mechanism, the spring piston, the plurality of rotating latches, and the interlock transmission are mechanically interconnected;

wherein the primary lock prism is a hollow prism structure;

wherein the primary lock prism has a tube shape;

wherein the hollow interior space of the primary lock prism contains the spring mechanism, the spring piston, and the interlock transmission;

wherein the plurality of rotating latches mounts on the exterior surface of the lateral face of the primary lock prism.

2. The knife storage device according to claim 1 wherein the knife block comprises the interlock mechanism that inhibits an individual from removing an individual knife selected from the one or more knives from the knife block without releasing the interlock mechanism;

wherein the interlock mechanism is a lockable structure.

3. The knife storage device according to claim 2 wherein the one or more knives comprises a collection of individual knifes selected from the one or more knives.

4. The knife storage device according to claim 3 wherein the individual knife is a cutting tool;

wherein each individual knife is stored in the knife block;

wherein the knife block fastens each individual knife within the knife block until an individual knife selected from the one or more knives is released from the knife block.

5. The knife storage device according to claim 4 wherein the knife block further comprises a storage structure, one or more locking sleeves, and a knife lock;

wherein the one or more locking sleeves are formed in the storage structure;

wherein the knife lock and the interlock mechanism are contained in an interlock cavity formed in the storage structure;

wherein the interlock cavity is a negative space formed within the knife block;

wherein the interlock cavity contains the interlock mechanism.

6. The knife storage device according to claim 5 wherein the individual knife is sized to insert into a locking sleeve selected from the one or more locking sleeves;

wherein the selected locking sleeve receives the individual knife such that the individual knife is properly positioned within the selected locking sleeve to receive a rotating latch selected from a plurality of rotating latches that is associated for use with the selected locking sleeve.

7. The knife storage device according to claim 6 wherein each individual knife selected from the one or more knives comprises a blade, a handle, a bolster, and a latch strike;

wherein the blade forms the working element of the individual knife;

wherein the handle is a grip;

wherein the bolster is a mechanical structure;

wherein the bolster attaches the handle to the blade;

wherein the latch strike is an aperture that is formed through the faces of the blade with the two greatest surface areas.

8. The knife storage device according to claim 7 wherein the storage structure is a mechanical structure;

wherein the storage structure forms the primary shape of the knife block;

wherein each of the one or more locking sleeves is a negative space;

wherein each of the one or more locking sleeves is a slot;

wherein each of the one or more locking sleeves is sized to receive an individual knife selected from the one or more knives.

9. The knife storage device according to claim 8 wherein each of the one or more locking sleeves is configured to receive a specifically selected individual knife such that the there is a one to one correspondence between the one or more locking sleeves and the one or more knives;

wherein each locking sleeve selected from the one or more locking sleeves interacts with the interlock mechanism such that the interlock mechanism will fix the position of the selected individual knife within the selected locking sleeve when the proper individual knife selected from the one or more knives inserts into the selected locking sleeve.

10. The knife storage device according to claim 9 wherein the interlock mechanism is a mechanical structure;

wherein the interlock mechanism is a rotating structure;

wherein the interlock mechanism rotates between a first locked position and a first unlocked position;

wherein in the first locked position, the interlock mechanism prevents the removal of any individual knife selected from the one or more knives that is stored in the knife block;

wherein in the first unlocked position, the interlock mechanism enables the removal of any individual knife selected from the one or more knives when the interlock mechanism is properly released.

11. The knife storage device according to claim 10 wherein the interlock mechanism operates a mechanism that interacts with each of the one or more locking sleeves;

wherein a latching mechanism of the interlock mechanism further interacts with each of the one or more knives.

12. The knife storage device according to claim 11 wherein the knife lock is a lock;

wherein the knife lock attaches to the interlock mechanism;

wherein the knife lock moves between a second locked position and a second unlocked position;

wherein in the second locked position, the knife lock prevents the rotation of the interlock mechanism;

wherein in the second unlocked position, the knife lock enables the rotation of the interlock mechanism.

13. The knife storage device according to claim 12 wherein the spring mechanism is a spring based structure;

wherein the spring mechanism is a prism-shaped structure;

wherein the spring mechanism mechanically attaches to the spring piston and the interlock transmission.

14. The knife storage device according to claim 13 wherein the spring piston attaches to the spring mechanism such that the application of a force to the spring piston changes the span of the length of the spring mechanism;

wherein the spring piston mounts within the spring mechanism and the interlock cavity of the knife block such that the spring piston is accessible from the exterior of the knife block;

wherein an externally provisioned force is applied to the spring piston in order to release the interlock mechanism such that an individual knife can be removed from its associated locking sleeve.

15. The knife storage device according to claim 14 wherein the plurality of rotating latches forms a rotating structure;

wherein the plurality of rotating latches attach to the interlock transmission such that the interlock transmission controls the rotation of the plurality of rotating latches;

wherein each of the plurality of rotating latches rotates between the first locked position and the first unlocked position in unison;

wherein there is a one to one correspondence between the plurality of rotating latches and the one or more locking sleeves;

wherein each rotating latch selected from the plurality of rotating latches is positioned such that the selected rotating latch rotates into and rotates out its associated selected locking sleeve;

wherein each rotating latch selected from the plurality of rotating latches is positioned such that the selected rotating latch rotates into and rotates out the latch strike of the individual knife associated with the selected locking sleeve associated with the selected rotating latch.

16. The knife storage device according to claim 15 wherein the latch strike is sized to receive a rotating latch selected from the plurality of rotating latches;

wherein the selected rotating latch inserts through the latch strike when the spring mechanism is in its relaxed shape;

wherein the selected rotating latch withdraws from the latch strike when the spring mechanism is deformed by the spring piston;

wherein when the selected rotating latch is withdrawn from the latch strike, the removal of the individual knife from the associated locking sleeve is enabled.

17. The knife storage device according to claim 16 wherein the interlock transmission is a mechanical structure;

wherein the interlock transmission interacts with the spring mechanism such that the interlock transmission will rotate the plurality of rotating latches in response to the deformation of the spring mechanism by an external force;

wherein the interlock transmission positions each of the plurality of rotating latches in the first locked position when the spring mechanism is in its relaxed shape;

wherein the interlock transmission rotates each of the plurality of rotating latches towards the first unlocked position as the spring mechanism is deformed by and externally provisioned force transferred to the spring mechanism through the primary lock prism;

wherein the interlock transmission returns the plurality of rotating latches back to the first locked position as the spring mechanism returns to its relaxed shape.

18. The knife storage device according to claim 17 wherein the interlock transmission further interconnects with the knife lock;

wherein the knife lock moves and fixes the interlock transmission into the first locked position when the knife lock is in the second locked position;

wherein the knife lock allows the interlock transmission to operate freely when the knife lock is in the second unlocked position;

wherein the knife lock installs within the interlock cavity such that the knife lock is accessible from the exterior of the primary lock prism.

* * * * *